US007733283B2

(12) United States Patent
Sato et al.

(10) Patent No.: US 7,733,283 B2
(45) Date of Patent: Jun. 8, 2010

(54) ANTENNA DEVICE

(75) Inventors: Tsuyoshi Sato, Tokyo (JP); Yasunori Morimoto, Tokyo (JP)

(73) Assignee: Sumida Corporation (JP)

( * ) Notice: Subject to any disclaimer, the term of this patent is extended or adjusted under 35 U.S.C. 154(b) by 274 days.

(21) Appl. No.: 11/873,121

(22) Filed: Oct. 16, 2007

(65) Prior Publication Data

US 2009/0096705 A1 Apr. 16, 2009

(51) Int. Cl.
*H01Q 7/08* (2006.01)

(52) U.S. Cl. ..... 343/788; 343/713

(58) Field of Classification Search ..... 343/866, 343/741, 788, 787, 713
See application file for complete search history.

(56) References Cited

U.S. PATENT DOCUMENTS

| | | | | |
|---|---|---|---|---|
| 6,664,936 | B2 * | 12/2003 | Ieda et al. | 343/866 |
| 7,557,763 | B2 * | 7/2009 | Bilyeu et al. | 343/713 |
| 2001/0026244 | A1 * | 10/2001 | Ieda et al. | 343/867 |
| 2005/0030251 | A1 * | 2/2005 | Okamura et al. | 343/895 |
| 2007/0024516 | A1 * | 2/2007 | Araki et al. | 343/788 |

FOREIGN PATENT DOCUMENTS

| | | | |
|---|---|---|---|
| DE | 20318052 | U1 | 3/2004 |
| JP | 03265106 | | 11/1991 |
| JP | 06283361 | | 7/1994 |
| JP | 2000348957 | | 12/2000 |
| WO | WO02078016 | A1 | 10/2002 |
| WO | WO2005052963 | | 6/2005 |

* cited by examiner

*Primary Examiner*—HoangAnh T Le
(74) *Attorney, Agent, or Firm*—Stephen Chin; von Simson & Chin LLP

(57) ABSTRACT

An antenna device includes: a winding component having an approximately cylindrical shaped winding shaft portion and a flange portion disposed to project outside the winding shaft portion in at least one end portion of both end portions in an axial direction of the winding shaft portion; a pair of binding terminals disposed to project outside the flange portion in at least one of the flange portions; and a winding both ends of which are bound to the pair of binding terminals. The flange portion on which the binding terminals are disposed has an approximate disk shape. At least one binding terminal is disposed to be oriented along a direction approximately perpendicular to an outer periphery of the flange portion on which the binding terminal is disposed.

5 Claims, 7 Drawing Sheets

--PRIOR ART--

--PRIOR ART--

--PRIOR ART--

--PRIOR ART--

ANTENNA DEVICE

BACKGROUND OF THE INVENTION

1. Field of the Invention

The present invention relates to an antenna device.

2. Description of the Related Art

Japanese Patent Application Laid-Open No. 2000-348957 (Patent Document 1) discloses a zero phase sequence current transformer. The zero phase sequence current transformer includes a core piece, a secondary winding wound on the core piece, and an end joining terminal for binding an end of the secondary winding.

As described in Patent Document 1, the end of the winding wound on the core piece and the like is bound to a binding terminal called the end joining terminal and the like. Hereby, the winding becomes electrically connectable with another electrical component.

However, when the end of the winding wound on the core piece and the like as above is connected by being bound to the binding terminal, a part of the winding may protrude outside a flange portion of the core piece and the like to form a so-called aerial wiring portion.

If the aerial writing portion is formed, in an antenna device used in a keyless entry system of a vehicle, for example, it becomes highly possible that a disconnection of the winding occurs in the aerial wiring portion and its vicinity. Due to a vibration, heat and the like applied to the antenna device, the aerial wiring portion of the winding and its neighboring part becomes easy to hit an edge of the flange portion repeatedly or winding becomes easy to be disconnected.

In order that the disconnection due to formation of the aerial wiring portion in the winding becomes hard to occur, in a conventional antenna device, a part which may become an aerial wiring portion in a winding is folded back and brought into a twisted line structure to enhance strength or an adhesive (processing agent) is applied on the part which may become the aerial wiring portion in the winding, for example. However, in order to form the twisted line structure by folding back the winding, it is necessary to add a complicated work process for forming the twisted line. In order to apply the adhesive (processing agent), it is necessary to add other processes for its application, and for drying and curing. If such processes are performed to each antenna device, a manufacturing cost of the antenna device is raised compared with a manufacturing cost of a general coil element.

In view of the above-described problems in the antenna device, the present inventor makes the following consideration and completed the present invention.

FIG. 10A to FIG. 10D are explanatory views of types of winding methods for windings in conventional antenna devices. A winding component in four types of antenna devices shown in FIG. 10A to FIG. 10D includes a cylindrical shaped winding shaft portion 41 and a pair of flange portions 42 disposed on both ends in a shaft direction of the winding shaft portion 41. A pair of binding terminals 43 are disposed on the flange portion 42 having a disk shape, in a posture to be parallel to each other.

In FIG. 10A, the pair of binding terminals 43 are disposed on the same side of the flange portion 42 in a case that the flange portion 42 is divided suitably into two parts. Usually, as indicated by two dashed lines in FIG. 10A, the pair of binding terminals 43 are disposed at an angle equal to or less than 90 degrees with the winding shaft portion 41 being a reference. While a tension is applied to the winding 44, the winding 44 is first bound to the binding terminal 43 on a starting side in upper left of the drawing, next wound counterclockwise around the binding shaft portion 41, and finally bound to the binding terminal 43 on a finishing side in upper right. In a case of FIG. 10A, a part of the winding 44 (hereinafter, referred to as a lead-out part 45 of the winding 44 on the starting side of the winding 44) between a part bound to the binding terminal 43 on the starting side and a part wound around the winding shaft portion 41 does not become an aerial wiring portion protruding outside the flange portion 42. A part of the winding 44 (hereinafter referred to as a lead-out part 46 of the winding 44 on the finishing side) between the part wound around the winding shaft portion 41 or a part bound to the binding terminal 43 on the finishing side does not become an aerial wiring portion protruding outside the flange portion 42.

In FIG. 10B, the pair of binding terminals 43 are disposed on the same side of the flange portion 42 similarly to FIG. 10A. While a tension is applied to the winding 44, the winding 44 is first bound to the binding terminal 43 on a starting side in upper left of FIG. 10B, next wound clockwise around the winding shaft 41, and finally bound to the binding terminal 43 on a finishing side in upper right. In the case of FIG. 10B, a lead-out part 45 of the winding 44 on a starting side becomes an aerial wiring portion, when the winding shaft portion 41 is large to an extent that the winding shaft portion 41 is upper in the drawing than a base of a projecting part of the binding terminal 43 of the starting side. A lead-out part 46 of the winding 44 on the finishing side mostly becomes an aerial wiring portion.

In FIG. 10C, the pair of binding terminals 43 are disposed on opposite sides of the flange portion 42. More specifically, the pair of binding terminals 43 are disposed on the flange portion 42 at opposite positions in a manner that the winding shaft portion 41 intervenes in a space therebetween. While a tension is applied to the winding 44, the winding 44 is first bound to the binding terminal 43 on a starting side in upper left of FIG. 10C, next wound counterclockwise around the binding shaft portion 41, and finally bound to the binding terminal 43 on a finishing side in lower right of the drawing. In the case of FIG. 10C, a lead-out part 45 of the winding 44 on the starting side does not become an aerial wiring portion. A lead-out part 46 of the winding 44 on the finishing side mostly becomes an aerial wiring portion.

In FIG. 10D, the pair of binding terminals 43 are disposed on opposite sides of the flange portion 42 similarly to FIG. 10C. While a tension is applied to the winding 44, the winding 44 is first bound to the binding terminal 43 on a starting side in upper left of FIG. 10D, next wound clockwise around the winding shaft 41, and finally bound to the binding terminal 43 on a finishing side in lower right of the drawing. In the case of FIG. 10D, a lead-out part 45 of the winding 44 on the starting side becomes an aerial wiring portion, when the winding shaft portion 41 is large to an extent that the winding shaft portion 41 is upper in the drawing than a base of a projecting part of the binding terminal 43 of the starting side. A lead-out part 46 of the winding 44 on the finishing side does not become an aerial wiring portion.

As shown in these four examples of FIG. 10A to FIG. 10D, there is a possibility that an aerial wiring portion protruding outside a flange portion 42 is formed in a winding 44 of a conventional antenna device. In particular, as shown in FIG. 10C and FIG. 10D, when the pair of binding terminals 43 are disposed on the opposite sides of the flange portion 42, the aerial wiring portion is formed in the winding 44 even if a winding direction around the winding shaft portion 41 is clockwise or counterclockwise. In contrast, when the pair of binding terminals 43 are disposed on the same side of the flange portion 42 and when the winding direction is that of FIG. 10A, the aerial wiring portion is not formed. However, in the case of FIG. 10B, the aerial wiring portion is formed. Further, in the cases of FIG. 10A and FIG. 10B, it is required to wind the winding 44 in the direction shown in FIG. 10A in order to prevent an aerial wiring, so that a manufacturing process of an antenna device is restricted. In order that the aerial wiring portion is not formed, the winding direction or a number of turns of the winding 44 is limited. When the pair of binding terminals 43 are disposed as above on the opposite sides of the flange portion 42 in the conventional antenna device, there is a higher possibility of the aerial wiring portion being formed compared with a case that the pair of binding terminals 43 are disposed on the same side on the flange portion 42.

An object of the present invention is to obtain an antenna device in which an aerial wiring portion protruding outside a flange portion is hardly formed in a winding, when the winding is wound on a binding terminal and a winding component.

SUMMARY OF THE INVENTION

An antenna device according to the present invention includes: a winding component having an approximately cylindrical shaped winding shaft portion and a flange portion disposed to project outside the winding shaft portion in at least one end portion of both end portions in an axial direction of the winding shaft portion; a pair of binding terminals disposed to project outside the flange portion in at least one of the flange portions; and a winding both ends of which are bound to the pair of binding terminals. The flange portion on which the binding terminal is disposed has an approximate disk shape. At least one binding terminal of the pair of binding terminals is disposed to be oriented along a direction approximately perpendicular to an outer periphery of the flange portion on which the binding terminal is disposed.

If thus structure is adopted, when the winding is bound to the pair of binding terminals and wound on the winding shaft portion with a tension being applied to the winding, the winding is bound to base parts of the pair of binding terminals (bases of the parts projecting from the flange portion), regardless of a winding direction in relation to the winding shaft portion and so forth. Therefore, an aerial wiring portion protruding outside the flange portion is hardly formed in the winding.

The antenna device according to the present invention has a following feature in addition to the above-described structure of the invention. That is, the pair of binding terminals are disposed to be oriented along a radial direction approximately perpendicular to the outer periphery of the approximately disk shaped flange portion at opposite positions in a manner so that the winding shaft portion intervenes in a space between the pair of binding terminals.

For example, in the conventional antenna devices shown in FIG. 10A to FIG. 10D, when the pair of binding terminals are disposed at the opposite positions across the winding shaft portion, it is highly possible that the aerial wiring portion is formed. In contrast, by disposing the pair of binding terminals to be oriented along the approximately perpendicular direction to the outer periphery of the flange portion at the opposite positions as in the present structure, the aerial wiring portion comes not to be formed in the winding. The winding is bound to the base parts of the pair of binding terminals (bases of the parts projecting from the flange portion), regardless of the winding direction and in relation to the winding shaft portion and so forth. The aerial wiring portion protruding outside the flange portion is not formed in the winding.

The antenna device according to the present invention has a following feature in addition to the respective structures of the invention described above. That is, the pair of binding terminals are integrated by one to one ratio with a pair of user terminals for mounting the antenna device and are disposed on the same flange portion.

If the user terminal and the binding terminal are integrated and disposed on one common flange portion, the antenna device is to be mounted on a printed circuit board and the like via a side on which the pair of binding terminals are disposed (that is, a side on which the user terminal is disposed). The pair of binding terminals and both end portions of the winding which are bound thereto are easy to interfere with another member such as a printed circuit board at a time of mounting. In such a state, there is a possibility that the antenna device is mounted with the user terminal floating from the printed circuit board. To prevent such a situation, it is necessary that the binding terminal integrated with the user terminal has been bent so that the binding terminal is apart from the printed circuit board compared with the user terminal in a mounted state. Additionally, in the conventional antenna devices shown in FIG. 10A to FIG. 10D, for example, it is desirable to substantially bend the pair of binding terminals in order to reduce a possibility that the winding having become the aerial wiring portion repeatedly hits the flange portion and the like due to a vibration and the like.

In contrast, if the present structure is adopted, since the winding is bound to the base of the binding terminal, the aerial wiring portion is hard to be formed. Therefore, the pair of binding terminals are not required to be substantially bent in order to reduce the possibility of a disconnection due to the vibration and the like. Thought it is necessary that the pair of binding terminals have been bent to some extent so that the pair of binding terminals are apart (floating) from the printed circuit board in comparison with the user terminal in the mounted state, the pair of binding terminals may be slightly bent to an extent that the pair of binding terminals are hard to interfere with the printed circuit board. Therefore, the integrated user terminal and binding terminal have an approximately flat planar shape as a whole, and can be accurately positioned by being insert molded at a time of a resin molding, and can be easily disposed on the flange portion. In a state of being integrated with the binding terminal, it is possible to secure a terminal position accuracy of the user terminal as a surface mounted component by the resin molding.

The antenna device according to the present invention has a following feature in addition to the respective structure of the invention described above. That is, the integrated binding terminal and user terminal are disposed on the winding component by an insert molding at a time of resin molding the winding component.

If thus structure is adopted, the integrated binding terminal and user terminal can be disposed accurately in relation to the molded winding component. Further, the integrated binding terminal and user terminal are disposed on the winding component without requiring for a different operation.

The antenna device according to the present invention has a following feature in addition to the respective structure of the invention described above. That is, the binding terminal and the user terminal are integrated in an approximate V shape in which an interval of tips of the binding terminal and the user terminal broadens.

If thus structure is adopted, it is possible, in a state that the binding terminal is disposed to be oriented along the direction approximately perpendicular to the outer periphery of the flange portion, that the user terminal is also disposed to be oriented along a direction approximately perpendicular to the outer periphery of the flange portion. The interval between the binding terminal and the user terminal does not become narrower, so that the neighboring user terminal does not disturb an operation of winding on the binding terminal.

According to the present invention, an aerial wiring portion protruding outside a flange portion can be made hard to be formed when a winding is wound on a pair of binding terminal and a winding component.

DETAILED DESCRIPTION OF THE PREFERRED EMBODIMENT(S)

Hereinafter, an antenna device according to an embodiment of the present invention will be described based on the drawings.

Figure 1A:
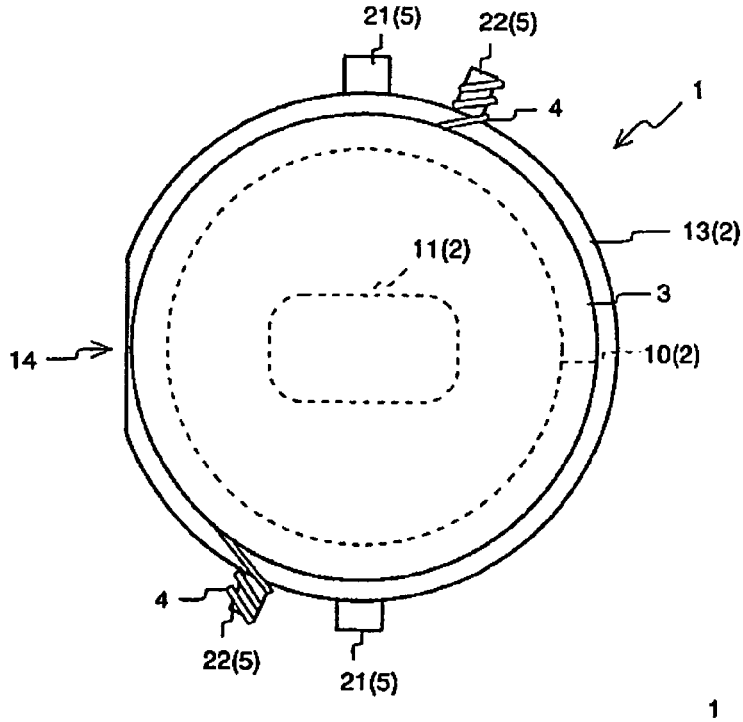
FIG. 1A to FIG. 1C are views showing an antenna device according to an embodiment of the present invention.
Figure 1B:
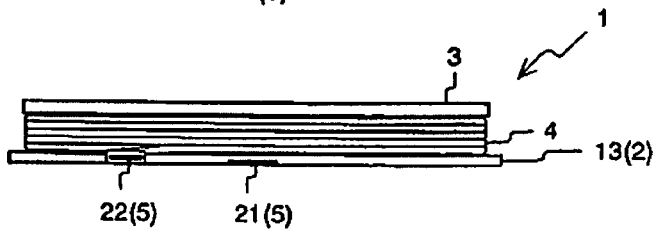
Figure 1C:
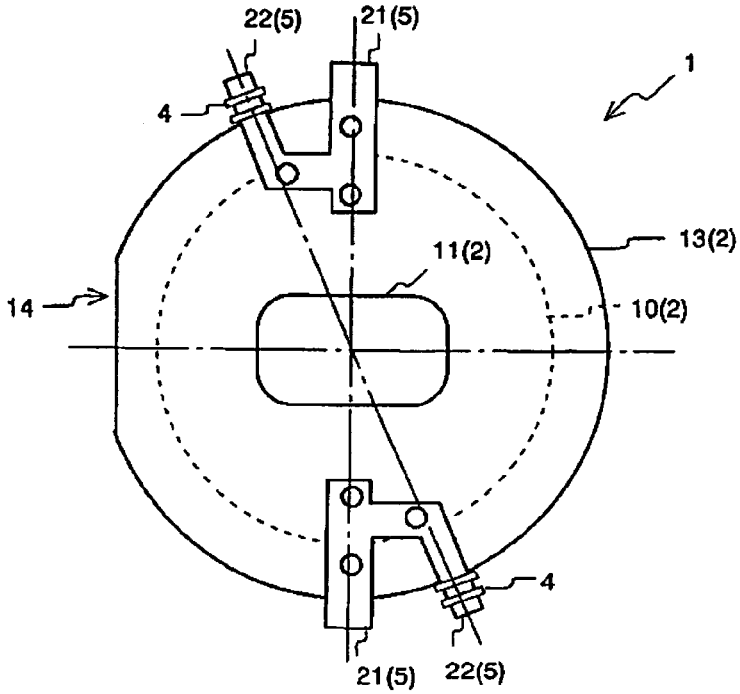

FIG. 1A to FIG. 1C are views showing an antenna device 1 according to the embodiment of the present invention. FIG. 1A is a front view of the antenna device 1, FIG. 1B is a side view of the antenna device 1, and FIG. 1C is a bottom view of the antenna device 1. The antenna device 1 is mounted on a printed circuit board and the like via a bottom surface.

The antenna device 1 is used in a keyless entry system in a vehicle such as an automobile. In particular, the antenna device 1 is built into a remote control unit of the keyless entry system.

The antenna device 1 includes a winding component 2 made of a nonmagnetic member formed into a bobbin shape, a protective cover 3, a winding 4 wound on the winding component 2, and a pair of terminal plates 5 to which both ends of the winging 4 are bound.

Figure 2:
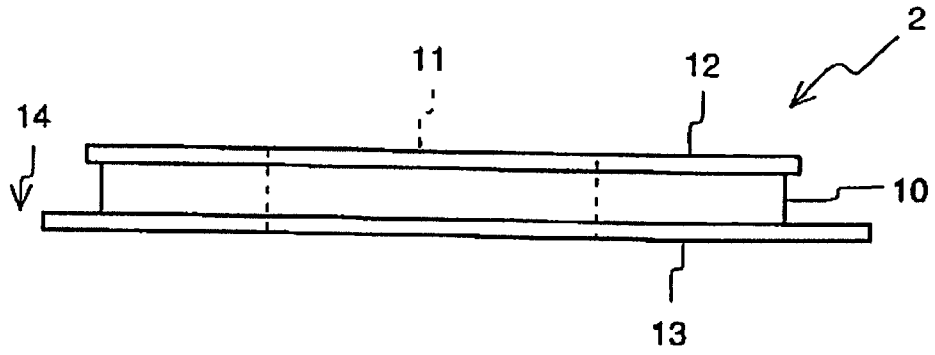
FIG. 2 is a side view showing a construction of a winding component in FIG. 1A to FIG. 1C.

FIG. 2 is a side view showing a construction of the winding component 2 shown in FIG. 1A to FIG. 1C. The winding component 2 includes a cylindrical shaped winding shaft portion 10. A center of the winding shaft portion 10 is provided with a long elliptical shaped through hole 11 pierced from a top surface to a bottom surface of the winding shaft portion 10.

A small diameter flange portion 12 as a flange portion is formed on one end portion (an upper-side end portion in FIG. 2) of both end portions in a shaft direction of the winding shaft portion 10. The small diameter flange portion 12 has a disk shape of a diameter larger than that of the winding shaft portion 10. The small diameter flange portion 12 projects outside the winding shaft portion 10.

A large diameter flange portion 13 as a flange portion is formed on the other end portion (an lower-side end portion in FIG. 2) of the both end portions in the shaft direction of the winding shaft portion 10. The large diameter flange portion 13 has a disk shape with a larger diameter than that of the small diameter flange portion 12. The large diameter flange portion 13 projects outside the winding shaft portion 10. Further, the large diameter flange portion 13 has a cut-out portion 14. Due to the cut-out portion 14, the large diameter flange portion 13 has an approximate D shape in cross-section.

The small diameter flange portion 12 and the large diameter flange portion 13 are disposed approximately in parallel to each other on a top and a bottom of the winding shaft portion 10. The large diameter flange portion 13 including the cut-out portion 14 projects outside the small diameter flange portion 12.

The winding component 2 including these winding shaft portion 10, small diameter flange portion 12 and large diameter flange portion 13 is integrally formed by molding a resin material. An outer shape of the winding component 2 is of a diameter of about 10 to 20 mm and of a thickness of about 1 to 3 mm.

The protective cover 3 is made of heat resistant plastic formed into a disk shape. A diameter of the protective cover 3 is slightly smaller than the diameter of the large flange portion 13 and larger than the diameter of the small diameter flange portion 12. The protective cover 3 is bonded on top of the small diameter flange portion 12 in a manner that a center of the protective cover 3 and a center of the winding component 2 coincide with each other.

Figure 3A:
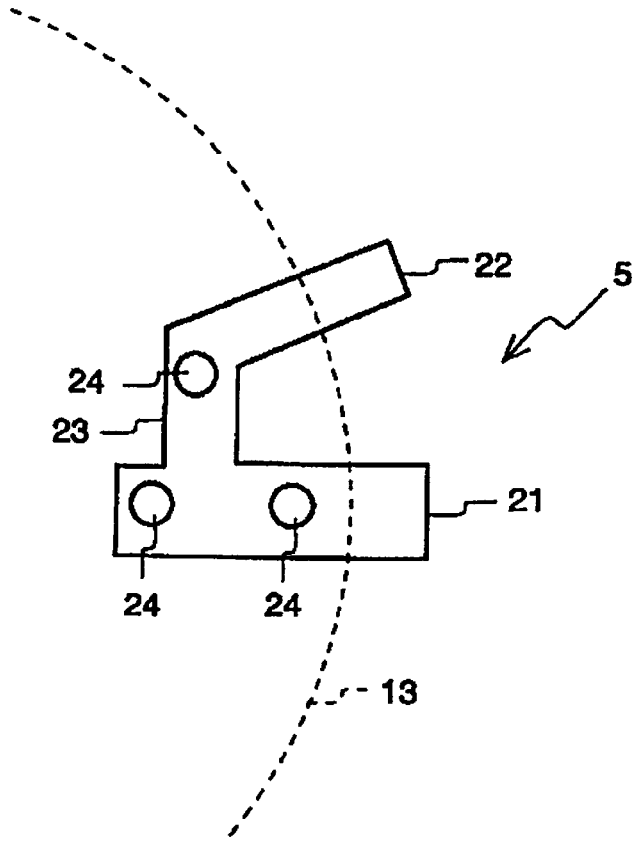
FIG. 3A and FIG. 3B are views showing a terminal plate in FIG. 1A to FIG. 1C FIG. 4A and FIG. 4B are schematic views for explaining winding methods of a winding in the antenna device shown in FIG. 1A to FIG. 1C.
Figure 3B:
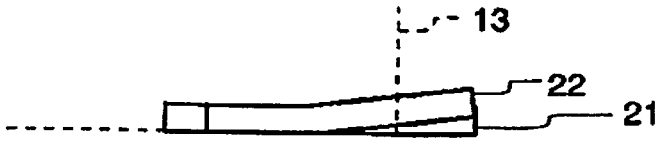

FIG. 3A and FIG. 3B are views showing the terminal plate 5 in FIG. 1A to FIG. 1C. FIG. 3A is a front view of the terminal plate 5, and FIG. 3B is a side view of the terminal plate 5. In FIG. 3A and FIG. 3B, an edge of the large diameter flange portion 13 in relation to the terminal plate 5 is indicated with a broken line.

The terminal plate 5 includes a user terminal 21 and a binding terminal 22. The user terminal 21 is to be soldered on the printed circuit board when the antenna device 1 is mounted on the printed circuit board and the like. On the binding terminal 22, the end portion of the winding 4 is to be bound and fixed. The user terminal 21 and the binding terminal 22 have rectangular shapes, that is, straight shapes without projections on side surfaces of the terminals. The rectangular shaped user terminal 21 and the rectangular shaped binding terminal 22 are coupled by a coupling member 23 on a base end side in a manner to be disposed in an approximate V shape with an interval of tip portions of the user terminal 21 and the binding terminal 22 broadening. A plurality of through holes 24 are provided on parts of the base end side of the coupling member 23 and the user terminal 21.

The terminal plate 5 including the user terminal 21, the binding terminal 22 and the coupling member 23 is integrally formed by punching a thin metal plate used for a terminal of an electronic component and the like by a presswork. A board thickness of the terminal plate 5 is approximately 0.1 to 1 mm.

The terminal plate 5 has an approximately flat planar shape with a tip portion of the binding terminal 22 being slightly bent toward the winding component 2 side, as shown in the side view of FIG. 3B. Hereby, the tip of the binding terminal 22 is slightly apart (floats) from a surface of the printed circuit board when the antenna device 1 is mounted on the printed circuit board and the like.

The pair of terminal plates 5 are disposed on the large diameter flange portion 13 of the winding component 2 as shown in FIG. 1A to FIG. 1C. A pair of the binding terminals 22 are disposed on opposite sides of the large diameter flange portion 13. A pair of the user terminals 21 are disposed on opposite sides of the large diameter flange plate 13. In other words, the pair of terminal plates 5 are disposed on the opposite positions across the winding shaft portion 10 so that the pair of binding terminals 22 are aligned in a straight line with the winding shaft portion 10 and so that the pair of user terminals 21 are aligned in a straight line with the winding shaft portion 10.

Further, the pair of terminal plates 5 are disposed in a posture that the pair of binding terminals 22 and the pair of user terminals 21 are oriented along a direction approximately perpendicular (in a perpendicular direction or in a direction quasi-equivalent thereto in which a similar effect can be obtained, that is, in a direction indicated by dashed lines in FIG. 1C) to outer peripheral surfaces of the large diameter flange portion 13 and the cylindrical shaped winding shaft portion 10, that is, oriented along a radial direction extending from a center of the circular shaped winding component 2, at the opposite positions.

The rectangular shaped user terminal 21 and the rectangular shaped binding terminal 22 are coupled in a manner to be disposed in the approximate V shape in which the interval between the tips thereof broadens. Therefore, in a state that the binding terminal 22 is disposed to be oriented along the direction approximately perpendicular to the outer periphery of the large diameter flange portion 13, the user terminal 21 can be also disposed to be oriented along the direction approximately perpendicular to the outer periphery of the large diameter flange portion 13. The interval between the binding terminal 22 and the user terminal 21 does not become narrower, so that a winding operation of the winding on the binding terminal 22 is easy. The interval between the binding terminal 22 and the user terminal 21 does not become narrower, so that it is possible that the neighboring user terminal 21 does not disturb at a time of the winding operation on the binding terminal 22.

The pair of terminal plates 5 may be disposed on the flange portion of the winding component 2 by an insert molding in a shaping die when the winding component 2 is formed by a resin molding, for example. The pair of terminal plates 5 are fixed on the winding component 2 by resin getting into the through holes 24. By disposing the pair of terminal plates 5 on the winding component 2 by the insert molding, the pair of terminal plates 5 are disposed accurately in the desired posture and position described above in relation to the large diameter flange portion 13, coupled with the fact that the shape of the terminal plate 5 is a thin planar shape (simple shape) which is almost unbent.

The winding 4 is an enameled wire whose cross-section is circular shaped (round linear shaped) or quadrangular shaped (rectangular shaped). A size of the winding 4 may be approximately 0.03 to 0.5 mm, for example. The winding 4 is wound on the winding shaft portion 10. The both end portions of the winding 4 are stripped of enamel coating, and thereafter bound to the pair of binding terminals 22 and soldered.

Figure 4A:
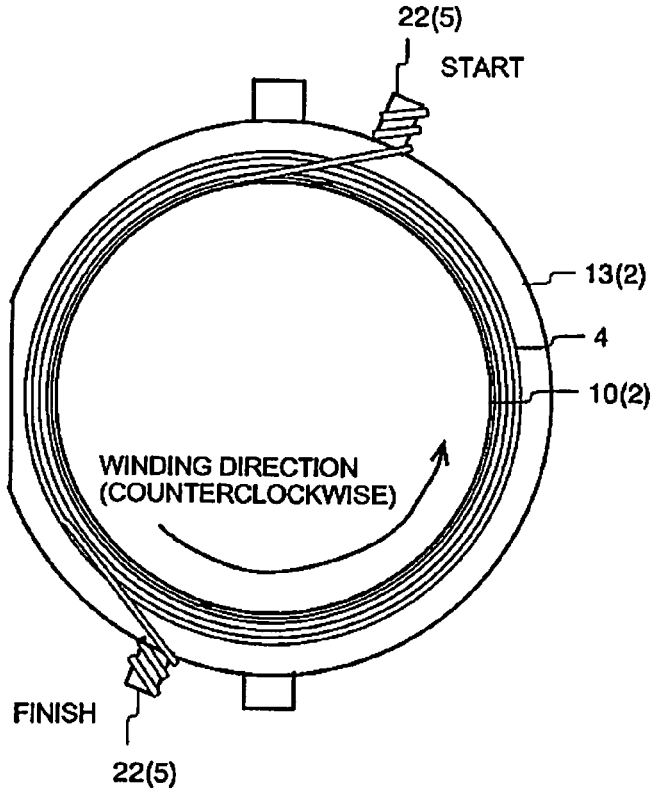
Figure 4B:
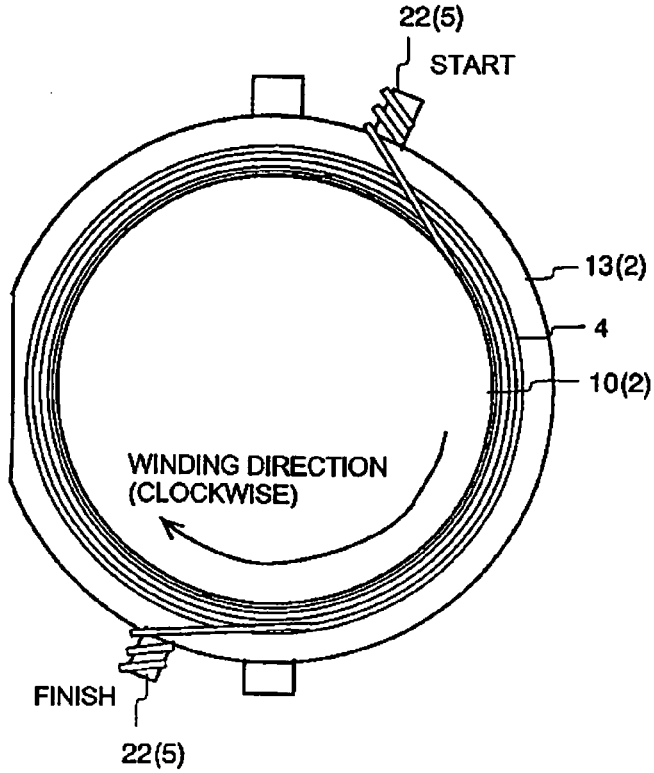

FIG. 4A and FIG. 4B are schematic views for explaining methods for winding the winding 4 in the antenna device shown in FIG. 1A to FIG. 1C. FIG. 4A is the schematic view of the antenna device 1 in a case that the winding 4 is first bound to the binding terminal 22 on the upper side of the drawing, next wound counterclockwise on the winding shaft portion 10, and finally bound to the binding terminal 22 on the lower side of the drawing. FIG. 4B is the schematic view of the antenna device 1 in a case that the winding 4 is first bound to the binding terminal 22 on the upper side of the drawing, next wound clockwise on the winding shaft portion 10, and finally bound to the binding terminal 22 on the lower side of the drawing. As described above, the winding 4 can be wound in two directions in relation to the winding shaft portion 10 in the antenna device shown in FIG. 1A to FIG. 1C.

More specifically, after the winding 4 is bound to the binding terminal 22 on the upper side of the drawing, the winding component 2 is fixed (chucked) on a spinning body, and a tensile tension is applied to the winding 4 in the above state while the winding component 2 and the spinning body is rotated, whereby the winding 4 is wound on the winding shaft portion 10. Further, after the winding 4 is wound on the winding component 2, a tensile tension is applied to the winding 4 while the winding 4 is bound to the binding terminal on the lower side of the drawing and then soldered.

As stated above, by winding the winding 4 on the winding shaft portion 10 while applying the tensile tension to the winding 4 and binding the winding 4 to the binding terminal 22 while applying the tensile tension to the winding 4, the winding 4 is wound on the winding shaft portion 10 and the pair of binding terminals 22 without being loosened. The winding 4 is wound on the winding shaft portion 10 in an aligned state. The winding 4 is wound on the winding component 2 for a desired winding number. As shown in FIG. 1B, the winding 4 is wound in a space between the large diameter flange portion 13 and the protective cover 3 of the winding component 2 for the desired winding number.

As shown in FIG. 3B, the tip of the binding terminal 22 is bent toward the winding component 2 side. The tip of the binding terminal 22 becomes slightly apart (floats) from the surface of the printed circuit board when the antenna device 1 is mounted on the printed circuit board and the like. Therefore, when the antenna device 1 is mounted on the printed circuit board in a state that the winding 4 is soldered to the tip portion of the binding terminal 22, the user terminal 21 does not float from the surface of the printed circuit board.

The pair of binding terminals 22 are disposed on the opposite sides in the large diameter flange portion 13. The pair of binding terminal 22 are disposed at positions to be aligned in a straight line, the positions being displaced 180 degrees based on the winding shaft portion 10 (positions of opposite sides in the large diameter flange portion 13). Further, at the opposite positions, the pair of binding terminals 22 are disposed in a posture to be oriented along the approximately perpendicular direction to the outer peripheral surfaces of the large diameter flange portion 13 and the winding shaft portion 10.

Therefore, when the winding 4 is wound on the pair of binding terminals 22 and the winding shaft portion 10 while the tensile tension being applied, the winding 4 is bound to base parts of the pair of binding terminals 22 (bases of the parts projecting from the large diameter flange portion 13). As shown in FIG. 4A and FIG. 4B, the winding 4 is bound to the base parts of the pair of binding terminals 22 (bases of the parts projecting from the large diameter flange portion 13), regardless of a winding direction of the winding 4 in relation to the winding shaft portion 10.

Figure 5:
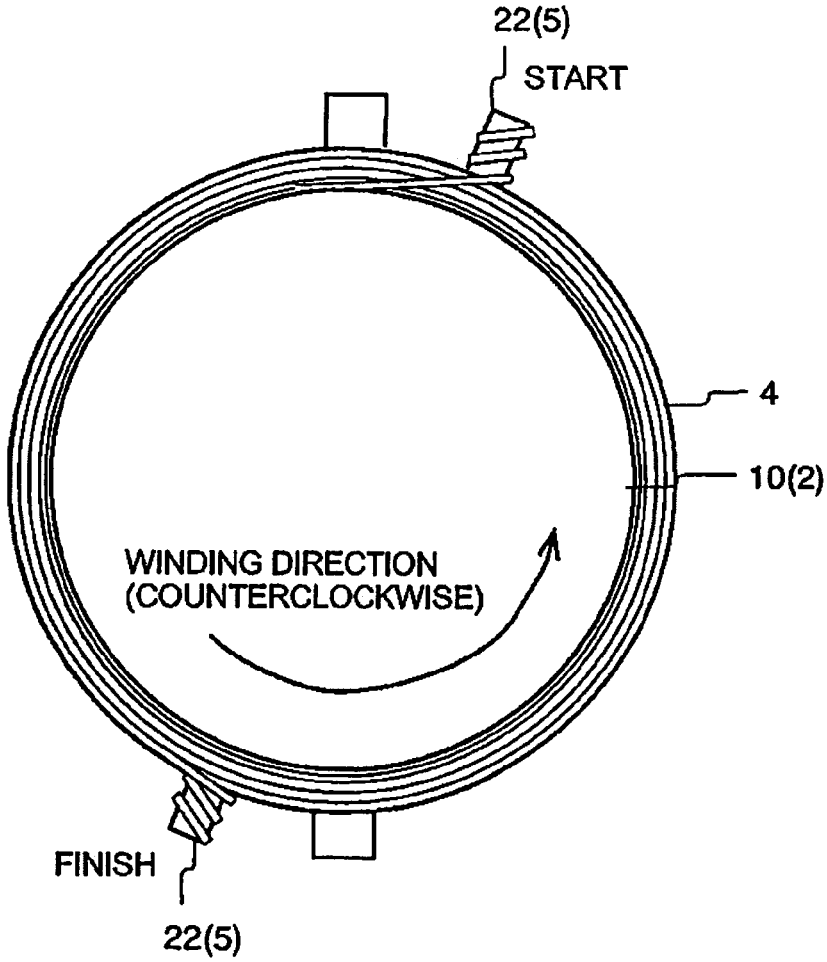
FIG. 5 is a schematic view for explaining a winding method of a winding in an antenna device whose winding shaft portion is larger in a diameter than that of the antenna device shown in FIG. 1A to FIG. 1C.

As shown in FIG. 5, a winding 4 is bound to base parts of a pair of binding terminals 22 (bases of the parts projecting from a large diameter flange portion 13) even when a diameter of a winding shaft portion 10 is large. FIG. 5 is a schematic view for explaining a winding method of a winding 4 in an antenna device 1 whose winding shaft portion 10 is larger than that of the antenna device 1 shown in FIG. 1A to FIG. 1C.

As a result, in the antenna device 1 according to the embodiment, the winding 4 is bound to the base parts of the pair of binding terminals 22 (bases of the parts projecting from the large diameter flange portion 13), regardless of the winding direction of the winding 4 in relation to the winding shaft portion 10 and a size of the diameter of the winding shaft portion 10. An aerial wiring portion is not formed in the winding 4 in a lead-out part at a starting side or a lead-out part at a finishing side of the winding 4, regardless of the winding direction in relation to the winding shaft portion 10 and the size of the diameter of the winding shaft portion 10.

Figure 6:
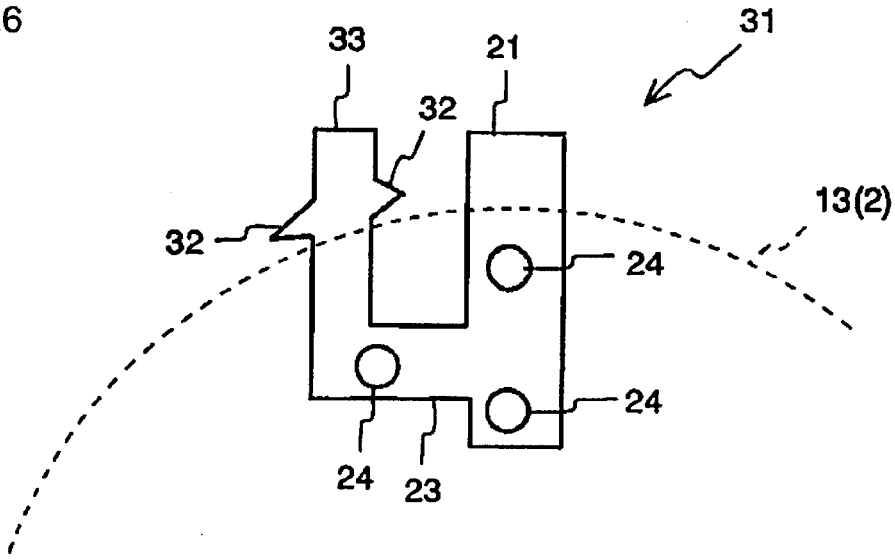
FIG. 6 is a front view of a terminal plate in an antenna device of a comparative example.

FIG. 6 is a front view of a terminal plate 31 in an antenna device 1 of a comparative example. The terminal plate 31 of the comparative example has a user terminal 21 of a rectangular shape and a binding terminal 33 in which a pair of projections 32 are formed on side surfaces of a rectangular shape. The user terminal 21 and the binding terminal 33 are coupled by a coupling member 23 in a manner to be approximately in parallel disposed. In FIG. 6 an edge of a large diameter flange portion 13 in relation to the terminal plate 31 of the comparative example is indicated by a broken line. The terminal plate 31 of the comparative example is positioned in a manner that the pair of projections 32 get along an outer peripheral edge of the large diameter flange portion 13, and then disposed on the large diameter flange portion 13.

In the terminal plate 31 of the comparative example shown in FIG. 6, a winding 4 is hooked by the pair of projections 32 when the winding 4 is bound to the binding terminal 33. The winding 4 is not displaced toward a tip side of the binding terminal 33 from the pair of projections 32. Therefore, the winding 4 is bound to base parts of the pair of binding terminal 33 (bases of the parts projecting from the large diameter flange portion 13) inside the pair of projections 32. In the winding 4, an aerial wiring portion becomes hard to be formed in a lead-out part on a starting side and in a lead-out part on a finishing side, regardless of a winding direction in relation to a winding shaft portion 10 and a size of a diameter of the winding shaft portion 10.

However, the terminal plate 31 of the comparative example shown in FIG. 6 is required to have a quite high position accuracy in relation to the edge of the large diameter flange portion 13. In order that the winding 4 is bound to the base parts of the pair of binding terminals 33 (bases of the parts projecting from the large diameter flange portion 13) by the winding 4 being hooked by the pair of projections 32, it is necessary that the pair of projections 32 are disposed accurately at positions adjacent to the outer peripheral edge of the large diameter flange portion 13. If the pair of projections 32 are disposed apart from the outer peripheral edge of the large diameter flange portion 13, the winding 4 is bound to parts nearer to the tip sides than the base parts of the pair of binding terminal 33. There occurs a possibility that the aerial wiring portion is formed in the winding 4. Therefore, in the terminal plate 31 of the comparative example shown in FIG. 6, a positioning operation in relation to the outer peripheral edge of the large diameter flange portion 13 is hard. It is difficult to dispose the terminal plate 31 of the comparative example on the large diameter portion 13 accurately enough by an insert molding.

In contrast, as in the embodiment, if the binding terminal 22 has a simple rectangular shape (straight shape) and the winding 4 is to be bound to the rectangular shaped (straight shaped) binding terminal 22, the winding 4 is firmly bound to the base parts of the pair of binding terminals 22 (bases of the parts projecting from the large diameter flange portion 13) even if the position accuracy of the binding terminal 22 in relation to the edge of the large diameter flange portion 13 is not high. The winding 4 is not bound with being displaced to the tip side of the binding terminal 22. The rectangular shaped binding terminal 22 in the embodiment is not required to have a high position accuracy as the position accuracy to the outer peripheral edge of the large diameter flange portion 13.

As stated above, according to the embodiment, the pair of terminal plates 5 having the user terminals 21 and the binding terminals 22 are disposed on the large diameter flange portion 13. The pair of binding terminals 22 are disposed to be oriented along the direction approximately perpendicular to the outer peripheral surfaces of the large diameter flange portion 13 and the winding shaft portion 10, that is, to be oriented along the radial direction extending from the center of the winding component 2, at positions opposite to each other across the winding shaft portion 10 in a manner to be aligned in a straight line with the winding shaft portion 10.

Therefore, when the winding 4 is bound to the pair of binding terminals 22 with the tension being applied, the winding 4 is strained by the tension and bound to the base parts of the pair of binding terminals 22 (bases of the parts projecting from the large diameter flange portion 13). The winding 4 is bound to the base parts of the pair of binding terminals 22 (bases of the parts projecting from the large diameter flange portion 13), regardless of the winding direction of the winding 4 in relation to the winding shaft portion 10 and so forth. Therefore, the aerial wiring portion protruding outside the outer peripheral edge of the large diameter flange portion 13 is not formed in the winding 4. The aerial wiring portion is not formed in the lead-out part on the starting side or the lead-out part on the finishing side of the winding 4.

Meanwhile, in the conventional antenna device 1, as described in Description of the Related Art, if the pair of binding terminals 22 are disposed at the positions of opposite sides facing across the winding shaft portion 10, there is a high possibility that an aerial wiring portion is formed.

As a result, if the antenna device 1 according to the embodiment is used for a keyless entry system of a vehicle and the like and a vibration and heat are applied, the lead-out part on the starting side and the lead-out part on the finishing side of the winding 4 do not repeatedly hit the edge of the flange portion. The winding 4 is hard to be disconnected. The winding 4 is hard to be disconnected even if the lead-out part on the starting side or the lead-out part on the finishing side of the winding 4 is not made to have a twisted line structure or is not fixed with an adhesive.

Further, the antenna device 1 according to the embodiment does not need a twisting process of a line or bonding process for preventing a disconnection of the lead-out part of the winding 4, and does not cause increases of a number of processes or of a cost due to such processes. The antenna device 1 according to the embodiment can be formed by the number of processes and the cost similar to those of another coil element using a winding 4.

In the present embodiment, the binding terminal 22 is integrated by one to one ratio with the user terminal 21 for mounting the antenna device 1. The pair of binding terminals 22 are disposed together with the pair of user terminals 21 on the large diameter flange portion 13 in common.

When the pair of binding terminals 22 integrated with the user terminals 21 are disposed on the same flange portion such as a large diameter flange portion 13, the antenna device is mounted on the printed circuit board and the like via a side on which the pair of binding terminals 22 are disposed. At the time of mounting, the pair of binding terminals 22 and both end portions of the winding 4 bound thereto tend to interfere with another member such as a printed circuit board. Therefore, in general, it is necessary to bend the pair of binding terminals 22 and the like so that the pair of binding terminals 22 are apart from the printed circuit board and the like farther than the pair of user terminals 22 in a mounted state. Also in order to make it harder for the winding 4 to hit the large diameter flange portion 13 and the like due to the vibration and the like, it is desirable to substantially bend the pair of binding terminals 22.

In contrast, in the present embodiment, the winding 4 is bound to the base of the binding terminal 22 and the aerial wiring portion is not formed. It is not necessary to substantially bend the pair of binding terminals 22 and the like in order to reduce a possibility of disconnection. The pair of binding terminals 22 and the like may be slightly bent to the extent not to interfere with another member such as a printed circuit board. Therefore, the pair of binding terminals 22 and the pair of user terminals 21 are insert-molded at the time of the resin molding, whereby the pair of binding terminals 22 and the pair of user terminals 21 can be accurately positioned and easily disposed on the large diameter flange portion 13 and the like at the time of the resin molding.

The above embodiment is an example of a preferred embodiment of the present invention, but the present invention is not limited thereto and various changes and modifications are possible without departing from the spirit or essential features of the invention.

In the above embodiment, the pair of binding terminals 22 are disposed on the opposite sides of the large diameter flange portion 13. Other than the above, for example, the pair of binding terminals 22 can be disposed on the same side of the large diameter flange portion 13 or the small diameter flange portion 12.

Figure 7A:
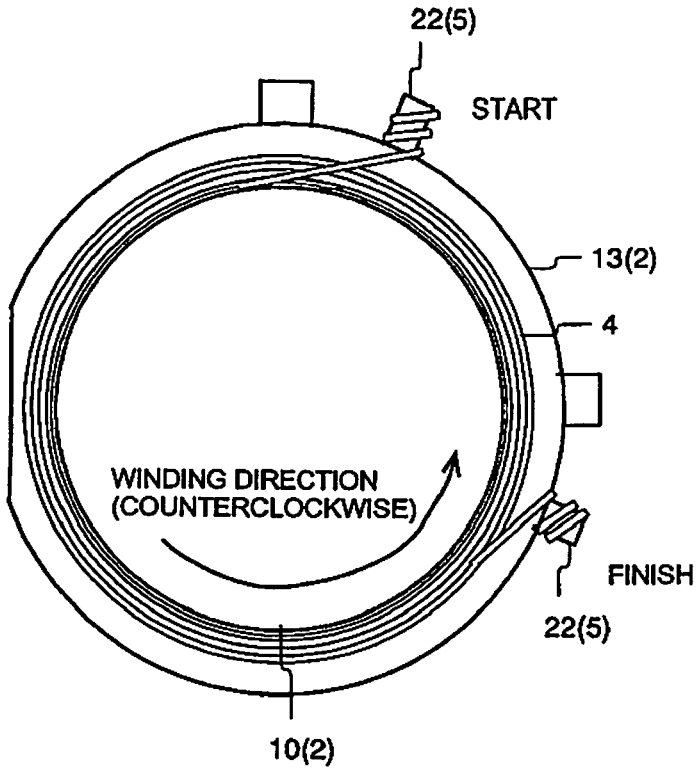
FIG. 7A and FIG. 7B are views showing examples of an antenna device in which a pair of binding terminals are disposed on the same side of a large diameter flange portion.
Figure 7B:
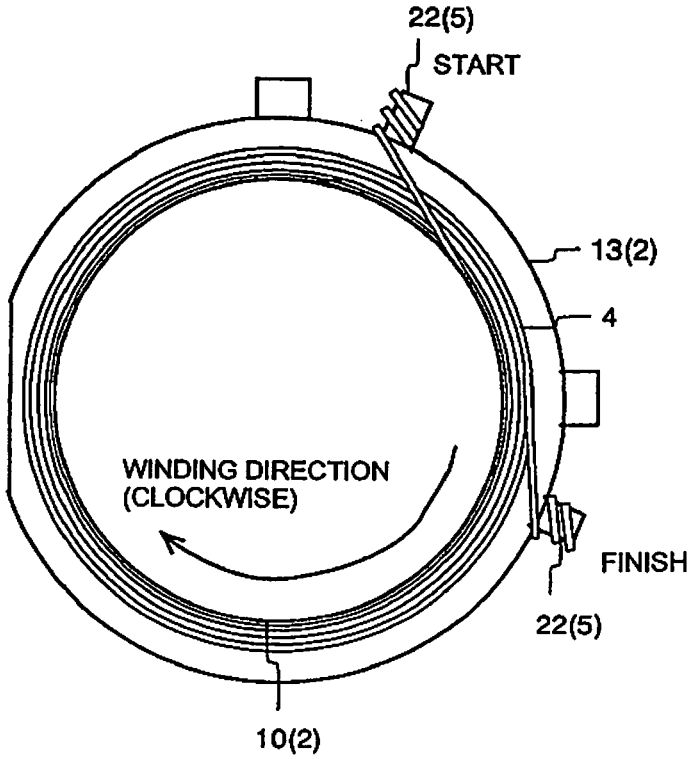

FIG. 7A and FIG. 7B are views showing examples of an antenna device 1 in which a pair of binding terminals 22 are disposed on the same side of a large diameter flange portion 13. In the antenna 1 in the modification example, the pair of binding terminals 22 are also disposed to be oriented along a direction approximately perpendicular to outer peripheral surfaces of the large diameter portion 13 and a winding shaft portion 10, that is, to be oriented along a radial direction extending from a center of a winding component 2. By such a disposing posture of the pair of binding terminals 22, even if a winding 4 is wound counterclockwise on the winding shaft portion as shown in FIG. 7A and even if the winding 4 is wound clockwise on the winding shaft portion 10 as shown in FIG. 7B, an aerial wiring portion is not formed in a lead-out part on a starting side or in a lead-out part on a finishing side of the winding 4. The winding 4 is bound to the pair of binding terminals 22 with a tension being applied, whereby the aerial wiring portion is not formed.

In the above embodiment, the pair of binding terminals 22 are both disposed to be oriented along the direction approximately perpendicular to the outer peripheral surfaces of the large diameter flange portion 13 and the winding shaft portion 10, that is, to be oriented along the radial direction extending from the center of the winding component 2. Other than the above, for example, only one of the pair of binding terminals 22 can be disposed to be oriented along the direction approximately perpendicular to the outer peripheral surfaces of the large diameter flange portion 13 and the winding shaft portion 10, that is, to be oriented along the radial direction extending from the center of the winding component 2.

In the above embodiment, the large diameter flange portion 13 of the winding component 2 is formed into the disk shape having the cut-out portion 14 while the winding shaft portion 10 is formed into the cylindrical shape. Other than the above, for example, the large diameter flange portion 13 and the winding shaft portion 10 of the winding component 2 can be formed into an approximate cylindrical shape or approximate disk shape such as an elliptical shape or an oval shape. One of the large diameter flange portion 13 and the winding shaft portion 10 can have one shape selected from the circular shape, the elliptical shape and the oval shape and the other may have one shape selected from the remainder.

Figure 8:
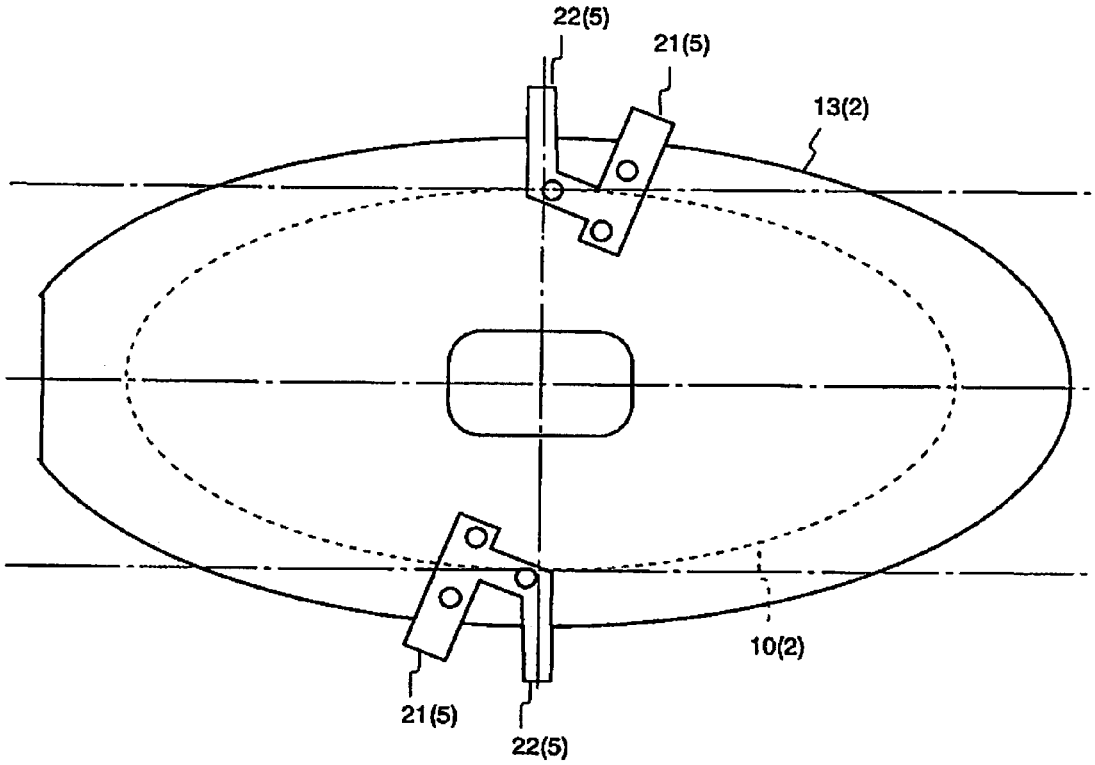
FIG. 8 is an explanatory view for an orientation of disposition of a pair of binding terminals in a modification example in which a large diameter flange portion and a winding shaft portion of a winding component are elliptical shaped.

Even with the shape of the winding component 2 in the above modification examples, the pair of binding terminals 22 may be disposed to be oriented along a direction approximately perpendicular to outer peripheries of a large diameter flange portion 13 and a winding shaft portion 10, as in the case illustrated in FIG. 8, that a large diameter flange portion 13 and winding shaft portion 10 of the winding component 2 are elliptical shaped, for example. Hereby, when a winding 4 is bound to the pair of binding terminals 22 with a tension being applied thereto, the winding 4 is strained by the tension and bound to base parts of the pair of binding terminals 22 (bases of the parts projecting from the large diameter flange portion 13). The winding 4 is bound to the base parts of the pair of binding terminals 22 (bases of the parts projecting from the large diameter flange portion 13), regardless of a winding direction of the winding 4 in relation to the winding shaft portion 10. FIG. 8 is an exemplary view of an orientation of disposition of a pair of binding terminals 22 in a modification example in which a large diameter flange portion 13 and a winding shaft portion 10 of a winding component 2 are elliptical shaped.

In the above embodiment, the pair of binding terminals 22 and a pair of user terminals 21 are disposed on the large diameter flange portion 13 in common. Other than the above, for example, at least one terminal of a pair of binding terminals 22 and a pair of user terminals 21 can be disposed on one flange of a large diameter flange portion 13 and a small diameter flange portion 12, the other terminal being disposed on the other flange portion.

Figure 9:
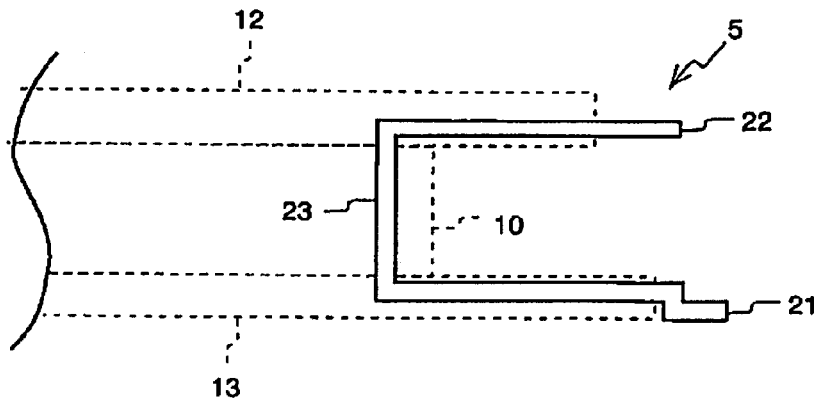
FIG. 9 is a cross-sectional view showing a structure and disposing state of a terminal plate in a case that a binding terminal and a user terminal electrically connected to each other are disposed on different flange portions.
Figure 10A:
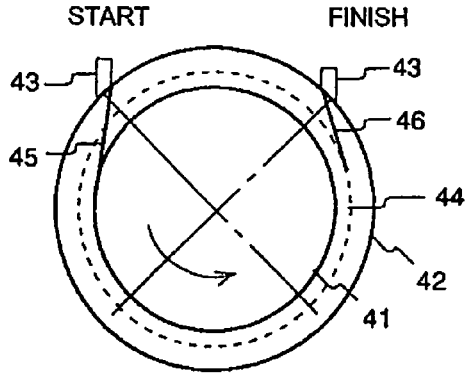
FIG. 10A to FIG. 10D are explanatory views of types of winding methods of windings in conventional antenna devices.
Figure 10B:
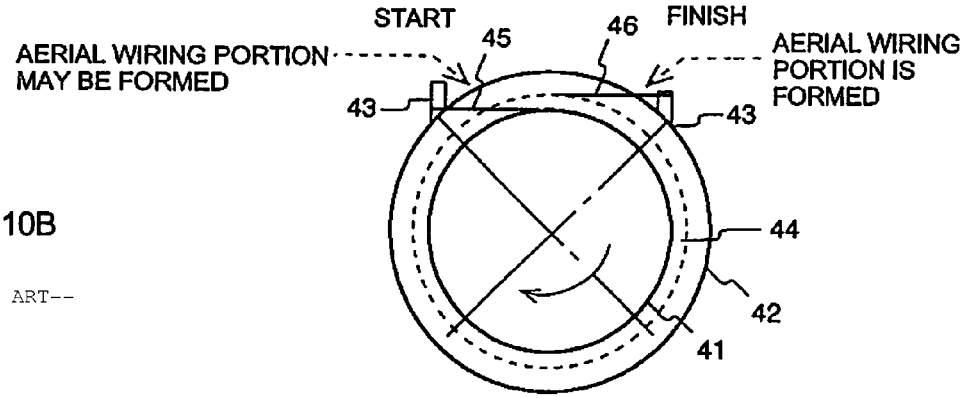
Figure 10C:
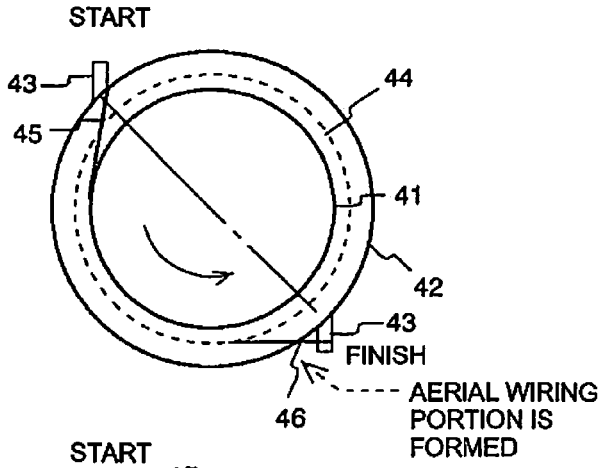
Figure 10D:
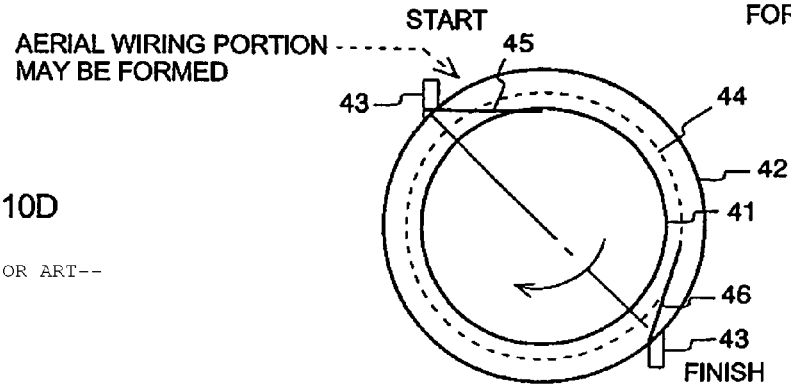

FIG. 9 is a cross-sectional view showing a structure and a disposing state of a terminal plate 5 in a case that a binding terminal 22 and a user terminal 21 electrically connected to each other are disposed on different flange portions. In the cross-sectional view, the binding terminal 22 is disposed on a small diameter flange portion 12 in the upper side of the drawing, while the user terminal 21 is disposed on a large diameter flange portion 13 in the lower side of the drawing. The user terminal 21 is bent to be flat with a bottom surface of the large diameter flange portion 13 in the lower side. The binding terminal 22 and the user terminal 21 are integrated inside the winding component 2 by a coupling member 23.

In the above embodiment, the binding terminal 22 of the terminal plate 5 is bent toward the winding component 2 side. Other than the above, for example, the user terminal 21 of the terminal plate 5 can be bent toward the opposite side of the winding component 2. The binding terminal 22 of the terminal plate 5 can be bent toward the winding component 2 side and the user terminal 21 can be bent toward the opposite side of the winding component 2.

In the above embodiment, a pair of the terminal plates 5 (a pair of the binding terminals 22 and a pair of the user terminals 21) are fixed on the large diameter flange portion 13 by being insert molded when the winding component 2 is molded from resin. Hereby, the pair of terminal plates 5 (the pair of binding terminals 22 and the pair of user terminals 21) are accurately positioned in relation to the large diameter flange portion 13 and the like and disposed. In a state of being integrated with the binding terminal 22, a terminal position accuracy of the user terminal 21 as a surface mount component can be secured by a resin molding. Other than the above, for example, a pair of terminal plates 5 (a pair of binding terminals 22 and a pair of user terminals 21) can be bonded to a molded large diameter flange portion 13 or small diameter flange portion 12 by an adhesive and the like.

In the above embodiment, the winding 4 is wound on a nonmagnetic winding component 2 made from a resin material. Other than the above, for example, a through hole can be formed in a center of a winding component 2 and in the through hole can be disposed a cross shaped magnetic core made from a magnetic material such as ferrite, two windings being applied on the magnetic core to make one of them a winding for an X axis and the other of them a winding for a Y axis, and a winding 4 wound on a winding shaft portion 10 being a winding for a Z axis, whereby a triaxial antenna device is made. Another electronic component such as a condenser and a switch can be disposed in the through hole in the center of the winding component 2. Further, other than the above, for example, a winding 4 can be wound on a magnetic core made by forming a magnetic material into an approximate bobbin shape, instead of the winding component 2. On the occasion, a pair of terminal plates 5 (a pair of binding terminals 22 and a pair of user terminals 21) may be fixed on the magnetic core by an adhesive and the like, for example.

The antenna device 1 according to the above embodiment is an antenna device used in a keyless entry system in a vehicle such as an automobile. Other than this, for example, the antenna device 1 can be used as an antenna device used in an immobilizer of a vehicle, an antenna device used in a monitoring system equipped for opening/closing a key and the like in a house and the like, an antenna device used in a monitoring system notifying an air pressure of a tire and the like at a start time of an engine or at a running time, and an antenna device used in a mobile device, a radio controlled watch or the like.

The present invention can be preferably used in the antenna device used for the keyless entry system of the vehicle.

What is claimed is:

1. An antenna device comprising:

a winding component having a cylindrical shaped winding shaft portion and a flange portion disposed to project outside the winding shaft portion in at least one end portion of both end portions in an axial direction of the winding shaft portion;

a pair of binding terminals disposed to project outside the flange portion; and a winding both ends of which are bound to said pair of binding terminals, wherein the flange portion on which said pair of binding terminals are disposed has a disk shape, and wherein at least one binding terminal of said pair of binding terminals is disposed to be oriented along a radial direction perpendicular to an outer periphery of the flange portion on which said one binding terminal is disposed.

2. The antenna device according to claim 1, wherein said pair of binding terminals are disposed to be oriented along a radial direction perpendicular to the outer periphery of the approximately disk shaped flange portion at opposite positions in a manner that the winding shaft portion intervenes in a space between said pair of binding terminals.

3. The antenna device according to claim 1, wherein said pair of binding terminals are integrated by one to one ratio with a pair of user terminals for mounting the antenna device and are disposed on the same flange portion.

4. The antenna device according to claim 3, wherein said pair of binding terminals and said pair of user terminal which are integrated are disposed on said winding component by an insert molding at a time of resin molding said winding component.

5. The antenna device according to claim 3, wherein said pair of binding terminal and said pair of user terminals are integrated in an approximate V shape in which an interval of tips of said binding terminal and the user terminal broadens.

* * * * *